US007293898B2

(12) United States Patent
Kumthampinij et al.

(10) Patent No.: US 7,293,898 B2
(45) Date of Patent: Nov. 13, 2007

(54) PORTABLE LIGHT

(75) Inventors: Yos Kumthampinij, Jersey City, NJ (US); Kenneth Zorovich, Hoboken, NJ (US); Walter Andrew, Bordentown, NJ (US)

(73) Assignee: Princeton Tectonics, Inc., Bordentown, NJ (US)

( * ) Notice: Subject to any disclaimer, the term of this patent is extended or adjusted under 35 U.S.C. 154(b) by 136 days.

(21) Appl. No.: 11/194,083

(22) Filed: Jul. 29, 2005

(65) Prior Publication Data

US 2006/0067077 A1 Mar. 30, 2006

Related U.S. Application Data

(60) Provisional application No. 60/592,646, filed on Jul. 29, 2004.

(51) Int. Cl.
*F21V 29/00* (2006.01)
*F21V 33/00* (2006.01)
*F21L 4/04* (2006.01)

(52) U.S. Cl. ..... 362/294; 362/373; 362/184; 362/205; 362/218

(58) Field of Classification Search ..... 362/218, 362/373, 294, 184, 205; 361/719, 706, 710, 361/715, 720, 721
See application file for complete search history.

(56) References Cited

U.S. PATENT DOCUMENTS

| | | | | |
|---|---|---|---|---|
| 6,428,189 | B1 * | 8/2002 | Hochstein | 362/373 |
| 6,517,218 | B2 * | 2/2003 | Hochstein | 362/294 |
| 2003/0107885 | A1 * | 6/2003 | Galli | 362/205 |
| 2004/0264195 | A1 * | 12/2004 | Chang et al. | 362/294 |
| 2005/0174753 | A1 * | 8/2005 | Cao et al. | 362/106 |
| 2005/0243558 | A1 * | 11/2005 | Van Duyn | 362/294 |

* cited by examiner

*Primary Examiner*—Sandra O'Shea
*Assistant Examiner*—Sean P. Gramling
(74) *Attorney, Agent, or Firm*—Howson & Howson LLP

(57) ABSTRACT

A portable personal headlamp utilizes an array of light-emitting diodes on the front face of a circuit board. Arc-shaped projections on the front face of a finned heat sink are in heat-conducting relationship with printed conductors on the rear face of the circuit board, which partially surround one lead of each light-emitting diode.

7 Claims, 3 Drawing Sheets

PORTABLE LIGHT

CROSS-REFERENCE TO RELATED APPLICATION

This application claims priority, under 35 U.S.C. §119(e)(1), on the basis of provisional patent application 60/592,646, filed Jul. 29, 2004.

FIELD OF THE INVENTION

This invention relates to portable lights, and more particularly to a portable light in which illumination is produced by a plurality of light-emitting diodes.

BACKGROUND OF THE INVENTION

With the development, beginning around 1996, of light-emitting diodes (LEDs) capable of emitting white light, LEDs have come into use in flashlights, and in portable headlights for use in activities such as diving, cave exploration, hiking, camping, etc. Moreover, in recent years, with the development of more powerful LEDs, these devices have even displaced incandescent bulbs in some flashlights and personal headlamps. For illumination comparable to that of an incandescent flashlight or personal headlamp, manufacturers have incorporated multiple LEDs into a single lamp. In some cases, for maximum light output, all the LEDs can be operated together. Where maximum light output is not needed, groups of fewer than all of the LEDs in a multiple LED lamp can be selectively operated by suitable switching, in order to avoid excessive battery drain. A similar result can be achieved by electronically adjusting the duty cycle of an LED or group of LEDs.

Although LEDs are generally more efficient than incandescent bulbs insofar as the ratio of light output to electrical power input is concerned, the higher power LEDs still generate a substantial amount of heat, and can fail if they become too hot. Heretofore, it has been difficult to dissipate heat adequately in a high power LED light, especially where plural LEDs are arranged in close proximity to one another. Accordingly, it has been necessary to limit LED power input, or to operate the LEDs intermittently when utilizing maximum power.

BRIEF SUMMARY OF THE INVENTION

A general object of this invention is to provide a high power LED light with adequate heat dissipation so that it can be operated reliably over a long period of time.

A preferred portable light in accordance with the invention comprises a housing composed of a synthetic resin, a printed circuit board mounted within the housing and having a front face and an opposite back face, a plurality of light-emitting diodes mounted on the front face of the circuit board, and a metal heat sink. Each light-emitting diode has a lead which extends through the printed circuit board and is connected to a printed conductor on the back face of the board. The heat sink has a plurality of projections on a front side thereof, each projection being associated with a different one of the light-emitting diodes and being in heat-conducting relationship with the printed conductor to which the lead of its associated light-emitting diode is connected. A set of heat-dissipating fins is provided on the back side of the heat sink.

Preferably, the housing has an opening through which the heat-dissipating fins extend, and a protective cover composed of synthetic resin is connected to the housing but spaced from the heat-dissipating fins. This cover has a plurality of openings for the release of heat from said fins.

The printed conductor extends at least part way around the lead to which it is connected, and each projection on the heat sink has a contacting surface extending in an arc at least part way around the lead of its associated light-emitting diode. Each projection contacts an arc-shaped area of the printed conductor over substantially the entire length of its arc, which preferably subtends an angle of at least approximately 180 degrees, and is centered on the lead of the light-emitting diode with which the projection is associated. One lead of the light-emitting diode associated with the projection is connected to the printed conductor.

The front side of the heat sink preferably has a plurality of recesses, each recess receiving a second lead of an LED, and preventing the second lead from contacting the heat sink.

A reflector, having a plurality of through holes, is preferably disposed adjacent the front face of the circuit board, and each of the light-emitting diodes extends into one of the holes. The reflector has a plurality of pins extending therefrom through the circuit board and projecting rearward from the back face of the circuit board. The pins on the reflector fit into holes formed on the front face of the heat sink to maintain alignment of the heat sink with the circuit board.

Other objects, details and advantages of the invention will be apparent from the following detailed description when read in conjunction with the drawings.

DETAILED DESCRIPTION OF THE PREFERRED EMBODIMENT

Figure 1:
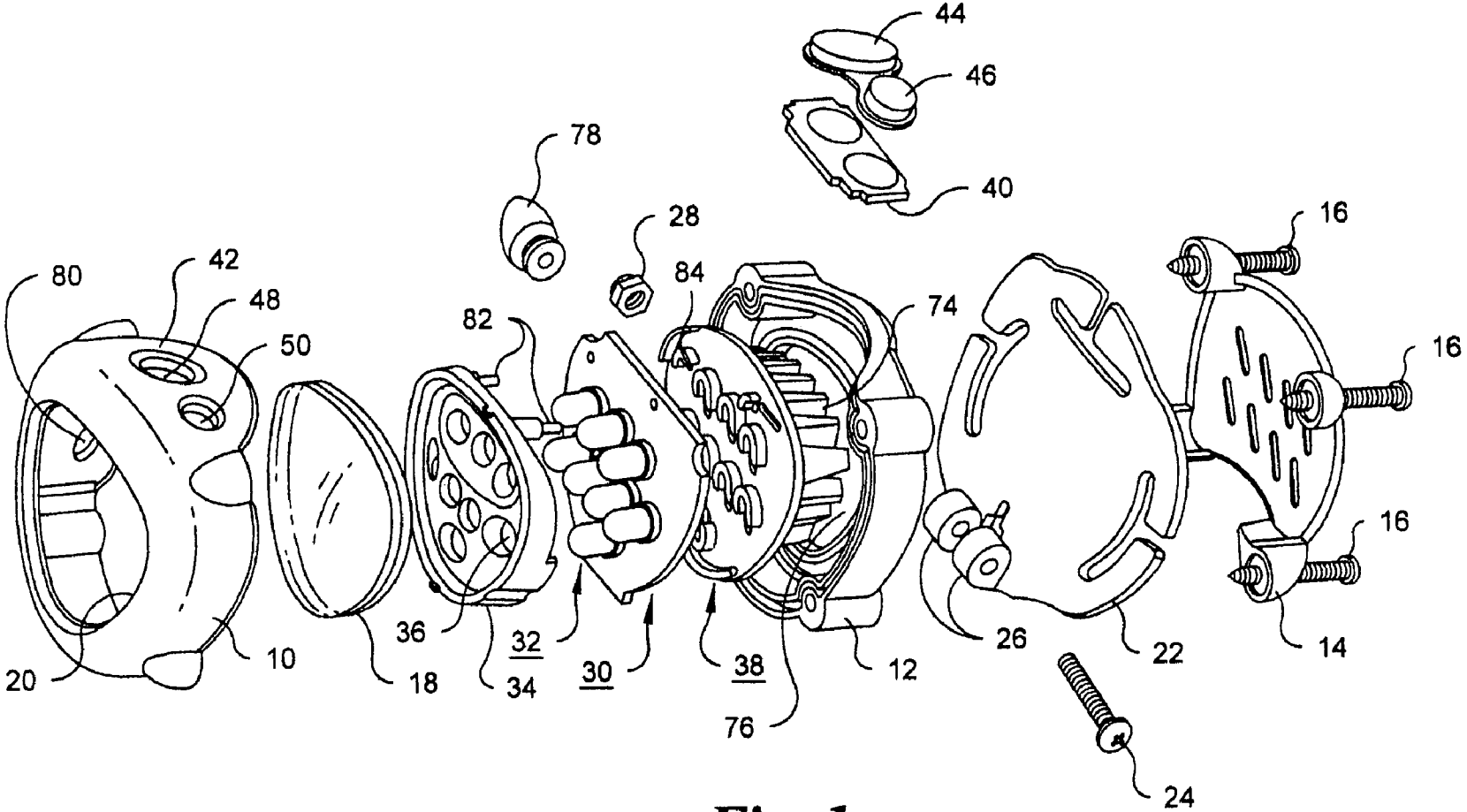
FIG. 1 is an exploded view of a portable lamp in accordance with a preferred embodiment of the invention.

The invention will be described as embodied in a personal headlamp designed to be worn on an individual's head with the aid of a flexible headband (not shown). As shown in FIG. 1, the housing of the portable light in accordance with the invention comprises a front part 10, a back part 12, and a back cover 14, all molded of a suitable synthetic resin. These three parts are secured together by screws 16.

A transparent lens 18 is secured by a suitable adhesive to the front part 10 of the housing, covering the front opening 20 therein, the adhesive providing a seal.

A bracket 22 is connected in pivoting relationship to the back housing part 12 by a pin 24, which extends through a pair of knuckles 26 formed on the bracket and a knuckle (not shown) formed on the housing part 12, which extends into a slot between knuckles 26. The pin is threaded into a lock nut 28. The knuckles and pin 24 cooperate to form a hinge, which allows the housing to be tilted relative to the bracket about a horizontal axis so that the beam of light can be aimed. The bracket is provided with slots for receiving head strap (not shown) so that the light can be worn on an individual's forehead. A separate battery pack (not shown) can be positioned on another part of the head strap for supplying electrical power to the light.

The three main elements inside the housing are a printed circuit board 30, on which an array 32 of light-emitting diodes (LEDs) is mounted, a molded reflector 34 having a set of through holes, e.g., hole 36 for receiving the LEDs, and a cast aluminum heat sink 38. In addition, the housing is provided with a switch assembly 40, which fits into a pair of opposed slots (not shown) underneath the top 42 of the front housing part 10, and a pair of flexible, elastomeric, push-buttons 44 and 46, by which the switches of the switch assembly 40 are operated manually. These push buttons fit, in sealing relationship, into holes 48 and 50, respectively, in top 42 of the front housing part.

The wiring and circuitry for operating the LEDs is straightforward and need not be described in detail. Preferably, the switch assembly will allow the user to activate all of the LEDs, or a small group thereof, depending on the required intensity of illumination.

Figure 2:
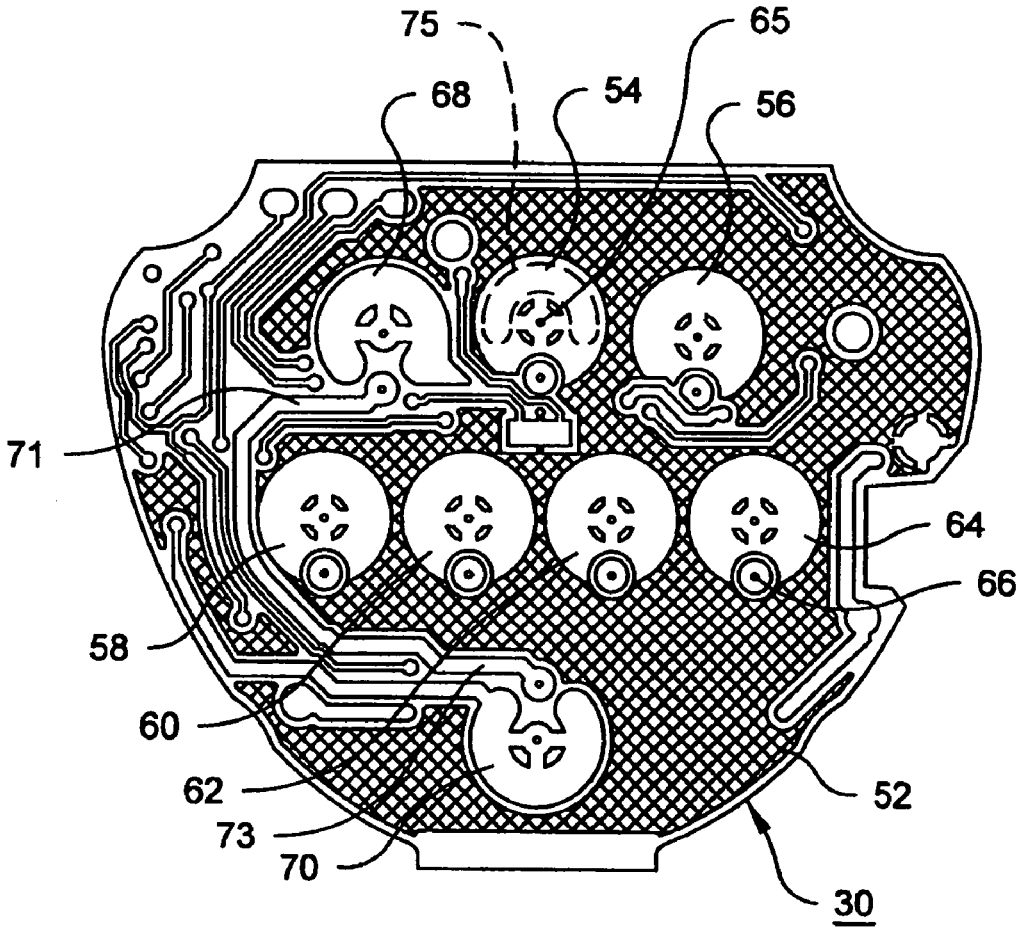
FIG. 2 is a plan view of the back face of the printed circuit board in FIG. 1.

As shown in FIG. 2, the back face of the circuit board 30 has a pattern of conductors printed thereon, including conductors for various circuit elements (not shown) as well as conductors for delivery of electrical current to the LEDs. These conductors are preferably coated with a very thin protective layer of electrical insulating material to prevent corrosion and to avoid short circuiting by stray conductive particles or minute pieces of wire.

In the embodiment shown, the LEDs are mounted on the circuit board, on the side opposite from the side shown in FIG. 2. A common printed conducting area 52, which covers most of the area of the circuit board, includes printed conductor areas 54, 56, 58, 60, 62 and 64, each of which extends part-way around one lead of an LED, which extends through the circuit board. For example, printed conductor area 54 extends part-way around LED lead 65 Preferably, each of these conductor areas subtends an angle of at least 180 degrees. In the case shown, the angle is approximately 315 degrees. The gaps between the ends of each conductor area leave room for electrical connection to the other leads of the LEDs, e.g., lead 66. The printed conductors (not shown) that are connected to these other leads are provided on the front face of the circuit board.

Two more printed conductor areas, 68 and 70, are electrically isolated from the common conducting area 52, to provide for selection of different groups of LEDs. In the embodiment shown, the user can select two, six, or all eight LEDs. The other leads of the two LEDs served by conductor areas 68 and 70 are connected to printed conductors 71 and 73 on the back face of the circuit board.

Figure 3:
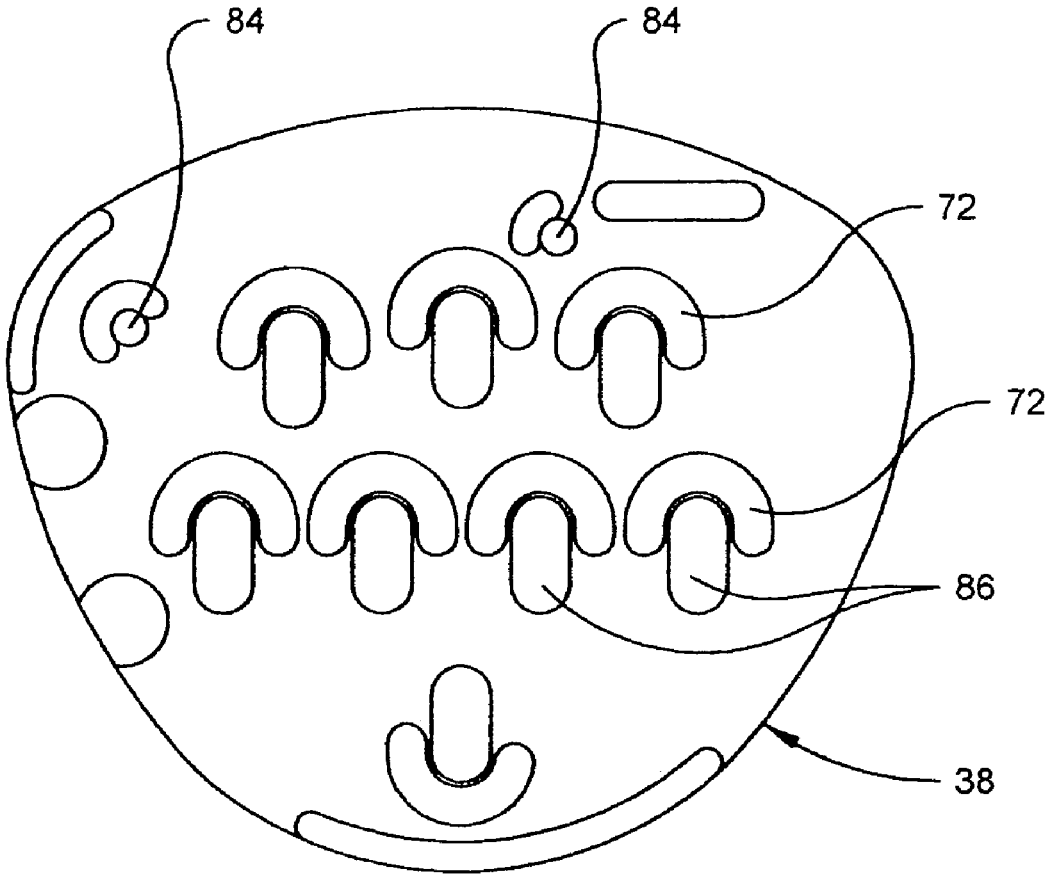
FIG. 3 is a plan view of the front side of the heat sink.

Arc-shaped projections on the front face of the heat sink press against the protective coating on the arcuate conductor areas, so that the projections and arcuate conductors are in heat-conducting relationship. As shown in FIG. 3, the projections, e.g. projections 72, have relatively broad, flat, contacting surfaces. An area 75, over which one of the projections 72 contacts printed area 54 is indicted by broken lines in FIG. 2. The arcuate configuration of the projections, and their broad contacting surfaces optimize the conduction of heat away from the LEDs. Thus, heat dissipated in the operation of each LED is conducted through one of the leads thereof to the corresponding arcuate conductor area on the opposite side of the circuit board, and conducted through the protective coating on the conductor area to the heat sink through one of the arcuate projections thereon. The heat is then dissipated by convection and radiation by the fins 74 (FIG. 1) of the heat sink, which extend rearward through a rear opening 76 in the housing part 12. The back cover 14 is spaced from the housing part 12 so that openings are provided at the top, at the bottom, and on both sides. In addition, the face of the back cover is provided with an array of openings, which, together with the openings on the top, bottom and sides, allow for the escape of heat by transfer to the surrounding atmosphere.

A sealing grommet 78 fits through an opening 80 in the front part of the housing for the entry of power leads from the battery pack into the interior of the housing. The heat sink is preferably sealed to the housing part 12 by a sealing ring clamped between the back wall of the heat sink and a groove, formed on an internal wall of housing part 12, so that the internal space within the housing, but in front of the heat sink, is completely sealed from the surrounding atmosphere. Thus the light can be used for underwater applications.

Alignment of the heat sink with the circuit board is maintained by pins 82, which extend rearward from the reflector 34, through the circuit board, and into holes 84, formed in the front face of the heat sink, as shown in FIG. 3. The front face of the heat sink also has elongated recesses 86, which accommodate portions of the LED leads which extend through the circuit board, preventing the LEDs from being short-circuited by the heat sink, and also allowing the heat sink to fit tightly against the circuit board without interference from the LED leads.

The invention allows for reliable operation of high-power LEDs over a relatively long time, in a compact light structure. The advantages of the invention may be realized in flashlights and other portable lighting devices as well as in personal headlamps, and in configurations other than the configuration specifically described. For example, the number of LEDs and their arrangement can be varied, and the shape of the housing and the arrangement of parts can be modified in various ways, such as by forming the LED leads so that only one lead of each LED extends through the circuit board while the other lead is connected to a conductor on the front side of the board. In the case where only one lead of each LED extends through the circuit board, the conductive area can surround the lead completely, and the projections of the heat sink can be in the form of complete circles rather than arcuate in shape.

Still other modifications may be made to the apparatus and method described above without departing from the scope of the invention as defined in the following claims.

The invention claimed is:

1. A portable light comprising:

a housing composed of a synthetic resin;

a printed circuit board mounted within the housing, said printed circuit board having a front face and an opposite back face;

a plurality of light-emitting diodes mounted on said printed circuit board and disposed on said front face of the printed circuit board, each said light-emitting diode having a lead which extends through the printed circuit board and is connected to a printed conductor on said back face of the printed circuit board;

a metal heat sink having a front side and a back side, said heat sink having a plurality of projections on the front side thereof, each said projection being associated with a different one of said light-emitting diodes, and each said projection being in heat-conducting relationship with the printed conductor to which the lead of its associated light-emitting diode is connected; and a set of heat-dissipating fins on said back side of the metal heat sink.

2. A portable light according to claim 1, in which said housing has an opening through which said heat-dissipating fins extend, and including a protective cover composed of synthetic resin, said cover having a plurality of openings for the release of heat from said fins, and being connected to the housing but spaced from said heat-dissipating fins.

3. A portable light according to claim 1, in which each said printed conductor extends at least part way around the lead to which it is connected, and in which each said projection has a contacting surface extending in an arc at least part way around the lead of its associated light-emitting diode, and contacts the printed conductor to which the lead of its associated light-emitting diode is connected over substantially the entire length of its arc.

4. A portable light according to claim 3, in which each said arc subtends an angle of at least approximately 180 degrees.

5. A portable light according to claim 4 in which the arc of each said projection is centered on the lead of the light-emitting diode with which the projection is associated.

6. A portable light according to claim 1, in which each said light-emitting diode has a second lead extending through the printed circuit board, and in which the front side of the heat sink has a plurality of recesses, each said recess receiving one of said second leads and preventing said second lead from contacting the heat sink.

7. A portable light according to claim 1, including a reflector having a plurality of through holes, said reflector being disposed adjacent the front face of the circuit board and each of the light-emitting diodes extending into one of said holes, said reflector having a plurality of pins extending therefrom through said circuit board and projecting rearward from the back face of the circuit board, and said heat sink having holes formed on its front side, the pins fitting said holes and maintaining alignment of said heat sink with said circuit board.

* * * * *